US007794374B1

(12) United States Patent
Park

(10) Patent No.: US 7,794,374 B1
(45) Date of Patent: Sep. 14, 2010

(54) ELASTIC DEVICE

(76) Inventor: Othili Park, 34 Providence St., West Warwick, RI (US) 02893

( * ) Notice: Subject to any disclaimer, the term of this patent is extended or adjusted under 35 U.S.C. 154(b) by 14 days.

(21) Appl. No.: 12/045,180

(22) Filed: Mar. 10, 2008

Related U.S. Application Data

(60) Provisional application No. 60/922,238, filed on Sep. 14, 2007.

(51) Int. Cl.
*A63B 21/02* (2006.01)

(52) U.S. Cl. ..... 482/122; 482/126

(58) Field of Classification Search ..... 482/121, 482/122, 126, 124; 119/769, 770, 795, 797, 119/798, 805; 24/300
See application file for complete search history.

(56) References Cited

U.S. PATENT DOCUMENTS

| | | | | | |
|---|---|---|---|---|---|
| 3,652,085 | A * | 3/1972 | Cole | 482/129 |
| 4,591,150 | A * | 5/1986 | Mosher | 482/125 |
| 4,733,862 | A * | 3/1988 | Miller | 482/126 |
| 4,909,505 | A * | 3/1990 | Tee | 482/129 |
| 5,125,649 | A * | 6/1992 | Fuller | 482/123 |
| 5,205,803 | A * | 4/1993 | Zemitis | 482/121 |
| 5,229,178 | A * | 7/1993 | Zemitis | 428/37 |
| 5,556,369 | A * | 9/1996 | Roberts | 482/131 |
| 5,607,736 | A | 3/1997 | Williams | |
| 5,628,695 | A | 5/1997 | Worthington et al. | |
| 5,800,322 | A | 9/1998 | Block | |
| 6,202,263 | B1 * | 3/2001 | Harker | 24/300 |
| 6,776,317 | B1 * | 8/2004 | Parker | 224/251 |
| 7,032,529 | B2 * | 4/2006 | Sanford | 114/230.2 |
| 7,141,012 | B2 * | 11/2006 | Lin | 482/126 |
| 7,175,574 | B2 * | 2/2007 | Carmel et al. | 482/124 |
| 7,384,382 | B2 * | 6/2008 | Farrah et al. | 482/124 |
| 7,458,135 | B2 * | 12/2008 | Mikesell et al. | 24/300 |
| 2004/0009858 | A1 * | 1/2004 | Tamaribuchi | 482/139 |
| 2005/0137066 | A1 * | 6/2005 | Wu | 482/126 |
| 2005/0252717 | A1 * | 11/2005 | Farrah et al. | 182/3 |
| 2008/0214369 | A1 * | 9/2008 | Mancini | 482/121 |

* cited by examiner

*Primary Examiner*—Loan Thanh
*Assistant Examiner*—Allana Lewin
(74) *Attorney, Agent, or Firm*—Salter & Michaelson

(57) ABSTRACT

An elastic device made of a flexible and stretchable resistance tube on the inside covered by a flexible and stretchable sleeve or sheath. The sleeve or sheath may be formed in an accordion-type pleat. An end connector is formed by providing a reversed loop in the center resistance tube that is engageable with a strap means that is threadable through the loop to form a knot for securing the strap means to the end of the flexible and stretchable resistance tube. The strap means may be provided in several different forms including a handle, link or clip. In another embodiment of the invention an elastic device is comprised of a flexible and stretchable resistance tube, and a connector means that is disposed at least one end of the tube, a solid ball member that is for insertion into a hollow end of the tube, and at least one strap disposed about a loop of the flexible and stretchable resistance tube adjacent to the rigid ball member.

3 Claims, 7 Drawing Sheets

ELASTIC DEVICE

RELATED CASES

Priority for this application is hereby claimed under 35 U.S.C. §119(e) to commonly owned and co-pending U.S. Provisional Patent Application No. 60/922,238 which was filed on Sep. 14, 2007 and which is incorporated by reference herein in its entirety.

TECHNICAL FIELD

The present invention relates in general to an elastic device that may be used for a variety of different applications. More particularly, the present invention relates to an improved end connector for the elastic device.

BACKGROUND OF THE INVENTION

Elastic cord devices are shown by way of example in U.S. Pat. Nos. 5,205,803 and 6,202,263. These devices generally include an inner cord and an outer sheath or sleeve. Various forms of end connectors are illustrated in the aforementioned patents. However, these end connector devices are of relatively complicated construction and do not provide for a ready attachment of a strap or the like at the end connector. The existing devices are also complicated to assemble and have weak points at their connection locations as many of the designs rely on putting holes in members which weakens them.

Accordingly, it is an object of the present invention to provide an improved elastic device and particularly an improved connector arrangement that may be used at one or both ends of the elastic device.

Another object of the present invention is to provide an improved elastic device that is of relatively simple construction and yet provides a strong connection arrangement.

SUMMARY OF THE INVENTION

In accordance with the present invention the basic elastic device is comprised of a flexible and stretchable resistance tube on the inside covered by a flexible and stretchable sleeve or sheath. The sleeve or sheath may be formed in an accordion-type pleat. The end connector is formed by providing a reversed loop in the center resistance tube that is engageable with a strap means that is threadable through the loop to form a knot for securing the strap means to the end of the flexible and stretchable resistance tube. The strap means may be provided in several different forms including a handle, link or clip.

In accordance with the invention there is provided an elastic device that is comprised of an inner flexible and stretchable resistance tube, an outer extendable sleeve member and a connector means at least one end of the tube and sleeve member. The connector means includes a strap means forming one of a closed and open section. The flexible and stretchable resistance tube has a turned end forming a loop and the strap section engages with the tube loop to form a knot about the tube loop.

In accordance with other aspects of the present invention the flexible and stretchable resistance tube is preferably an elastic tube; the outer sleeve member preferably has an accordion pleat; the strap means may be constructed of nylon or polypropylene; the strap means may include at least one of a handle, clip and link; the handle is preferably hollow and has the strap means extending therethrough and preferably the handle is passed through the tube loop to form the knot.

Also in accordance with the present invention there is provided a method of attaching a connector including a strap forming one of a closed and open section at the end of an elastic device that is comprised of an inner flexible and stretchable resistance tube and an outer extendable sleeve member that extends about the inner flexible and stretchable resistance tube. The method includes providing a turned end in the inner flexible and stretchable resistance tube to form a loop and having the strap section engage with the tube loop to form a knot about the tube loop.

Further steps regarding the method include providing a handle that is hollow and that has the strap means extending therethrough; passing the handle through the tube loop to form said knot; providing the strap as one of a closed loop and an open loop; providing the inner tube of an elastic material and providing the outer sleeve in an accordion pleat.

A further embodiment of the present invention comprises an elastic device that is comprised of a flexible and stretchable resistance tube, and a connector means that is disposed at least one end of the tube, a solid ball member that is for insertion into a hollow end of the tube, and at least one strap disposed about a loop of the flexible and stretchable resistance tube adjacent to the rigid ball member. The elastic device including a pair of straps one disposed on either respective side of the ball member. The elastic device of claim 1 wherein the flexible and stretchable resistance tube has an elongated slit so that when folded into a loop about the connector means the slotted end spreads and engages with a base end of the resistance tube.

DESCRIPTION OF THE DRAWINGS

It should be understood that the drawings are provided for the purpose of illustration only and are not intended to define the limits of the disclosure. The foregoing and other objects and advantages of the embodiments described herein will become apparent with reference to the following detailed description when taken in conjunction with the accompanying drawings in which.

DETAILED DESCRIPTION

Figure 1B:
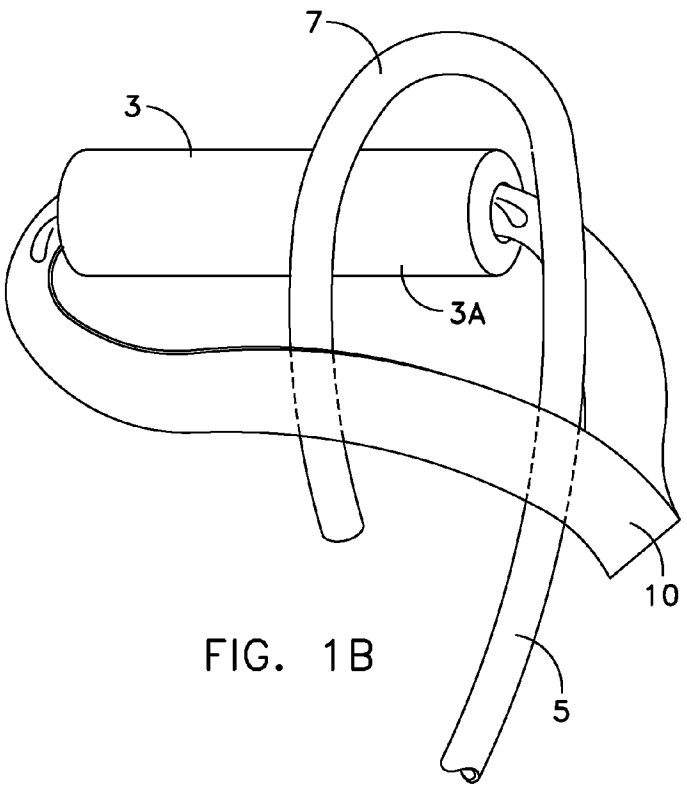
FIGS. 1A and 1B illustrate a first sequence in attaching the end connector.
Figure 1A:
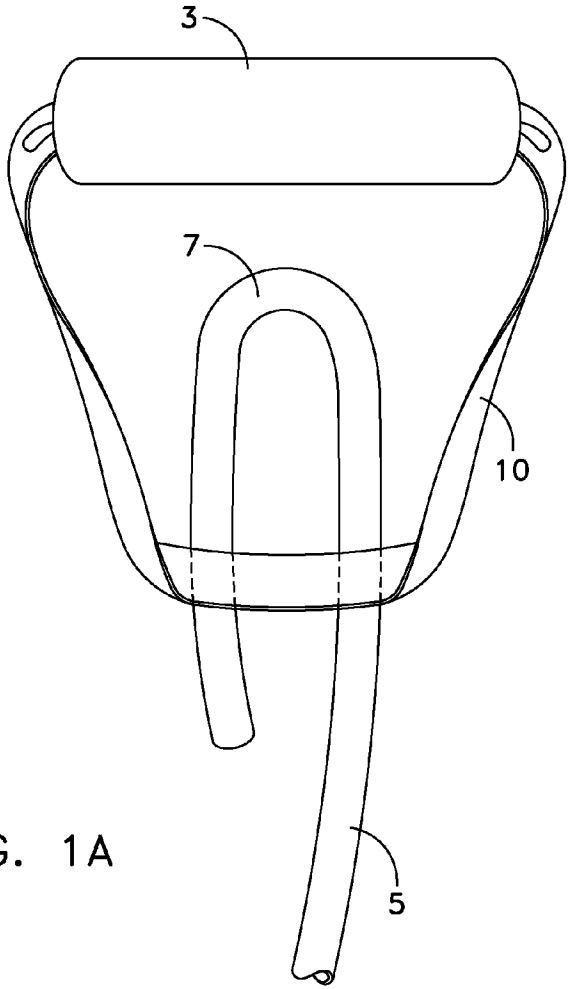
Figure 2A:
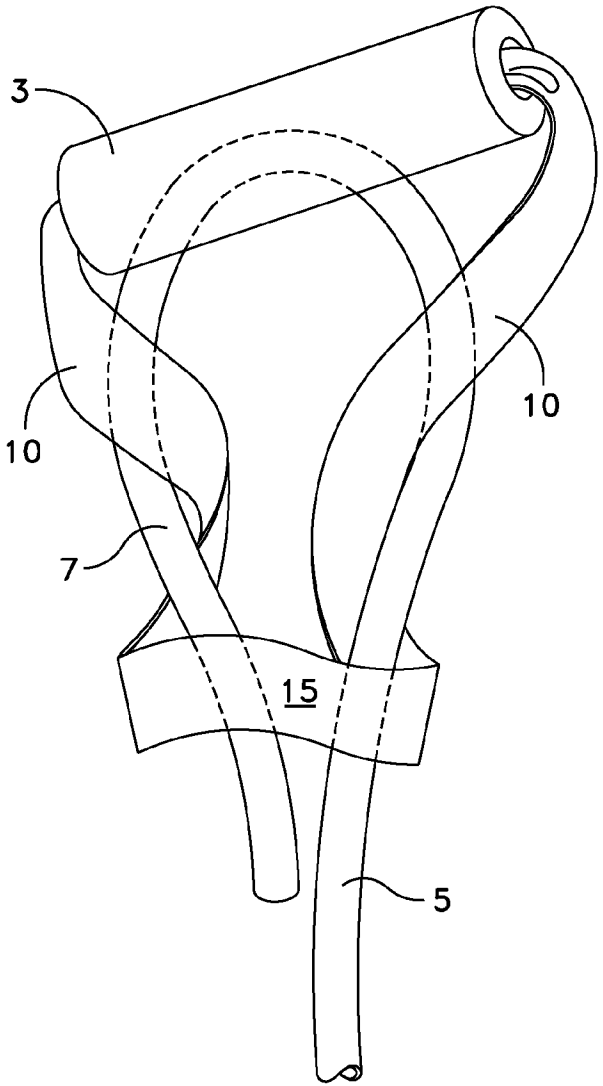
FIGS. 2A-2C illustrate a following sequence in forming the knot at the end connector.
Figure 2C:
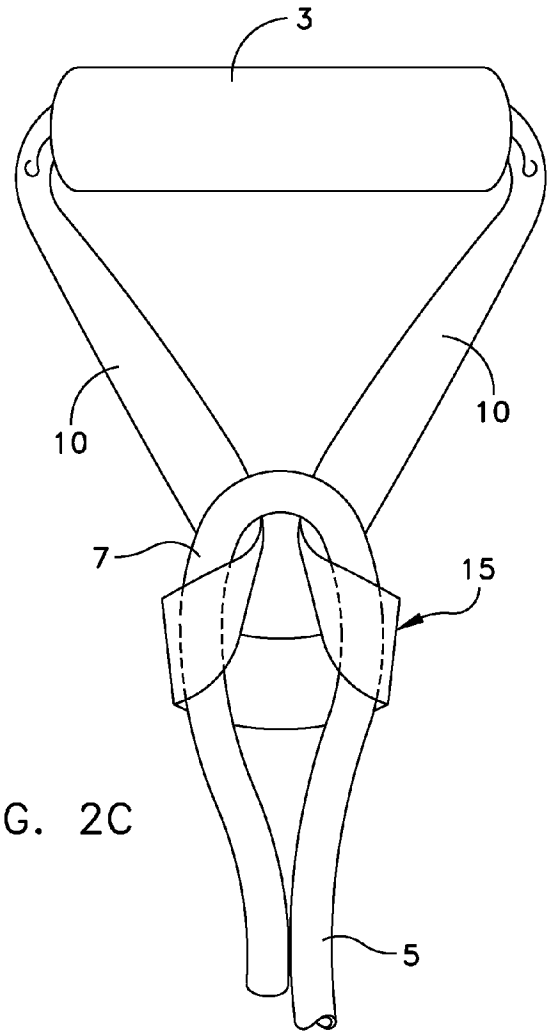
Figure 2B:
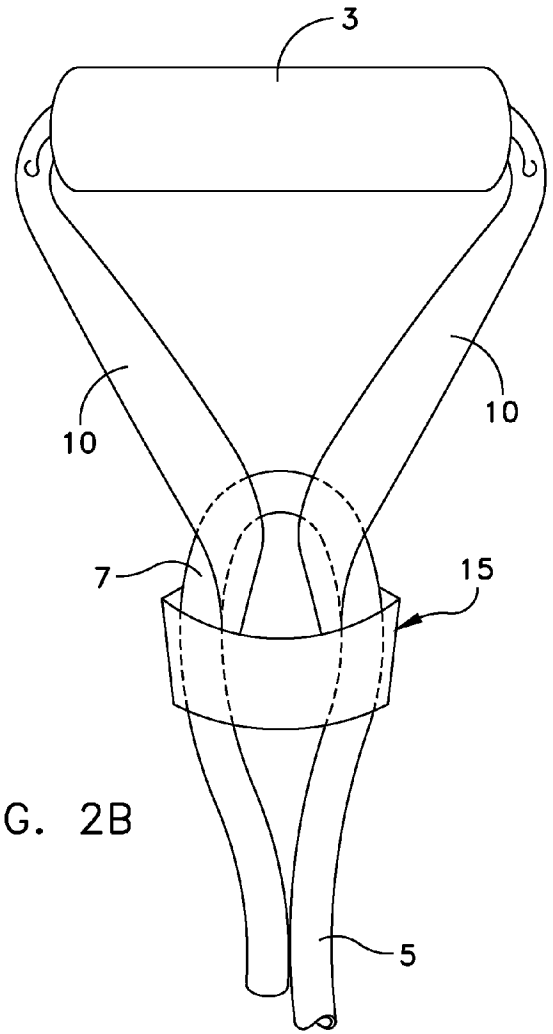
Figure 3:
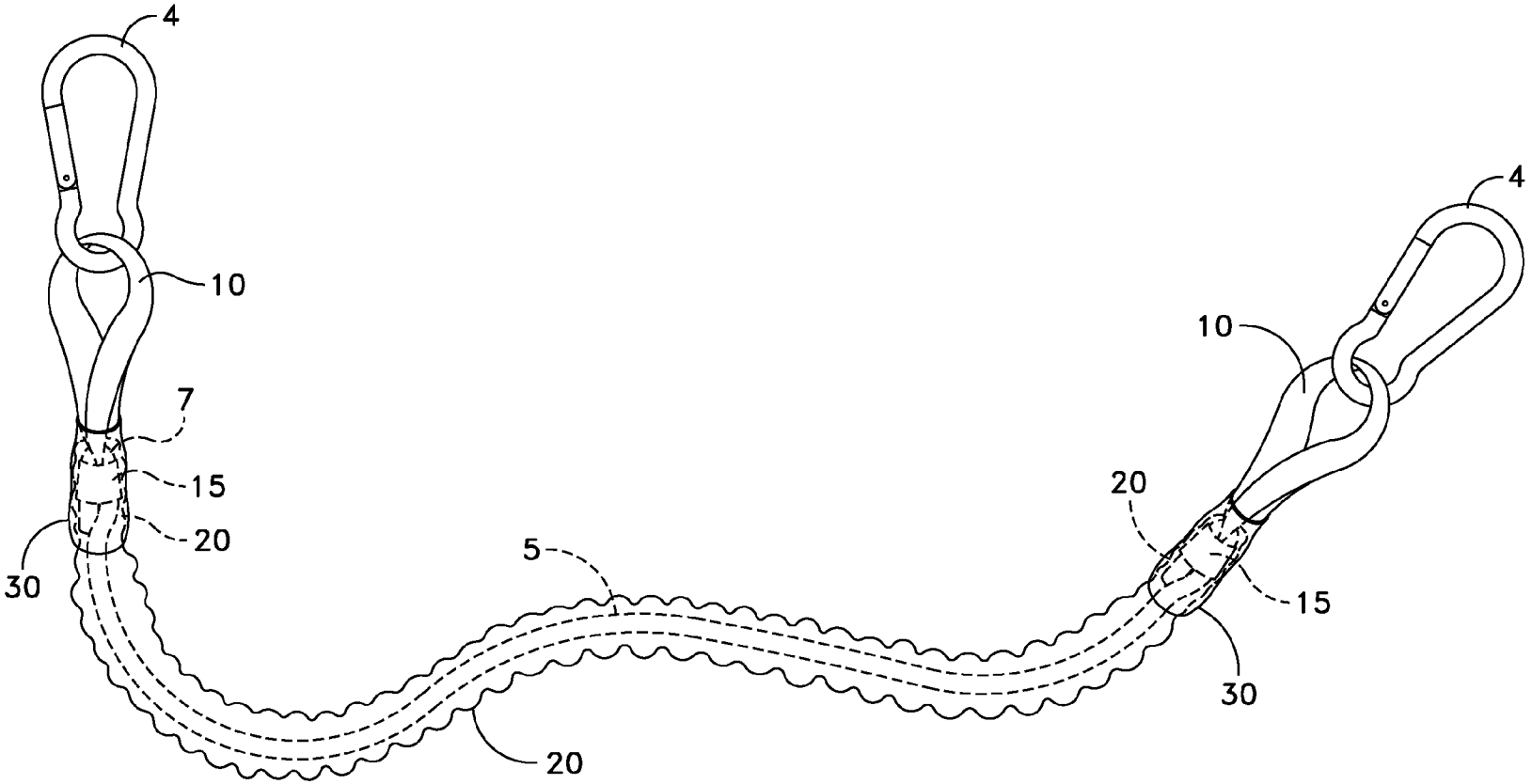
FIG. 3 is a schematic illustrating of the end connectors as attached to the complete elastic device.
Figure 4:
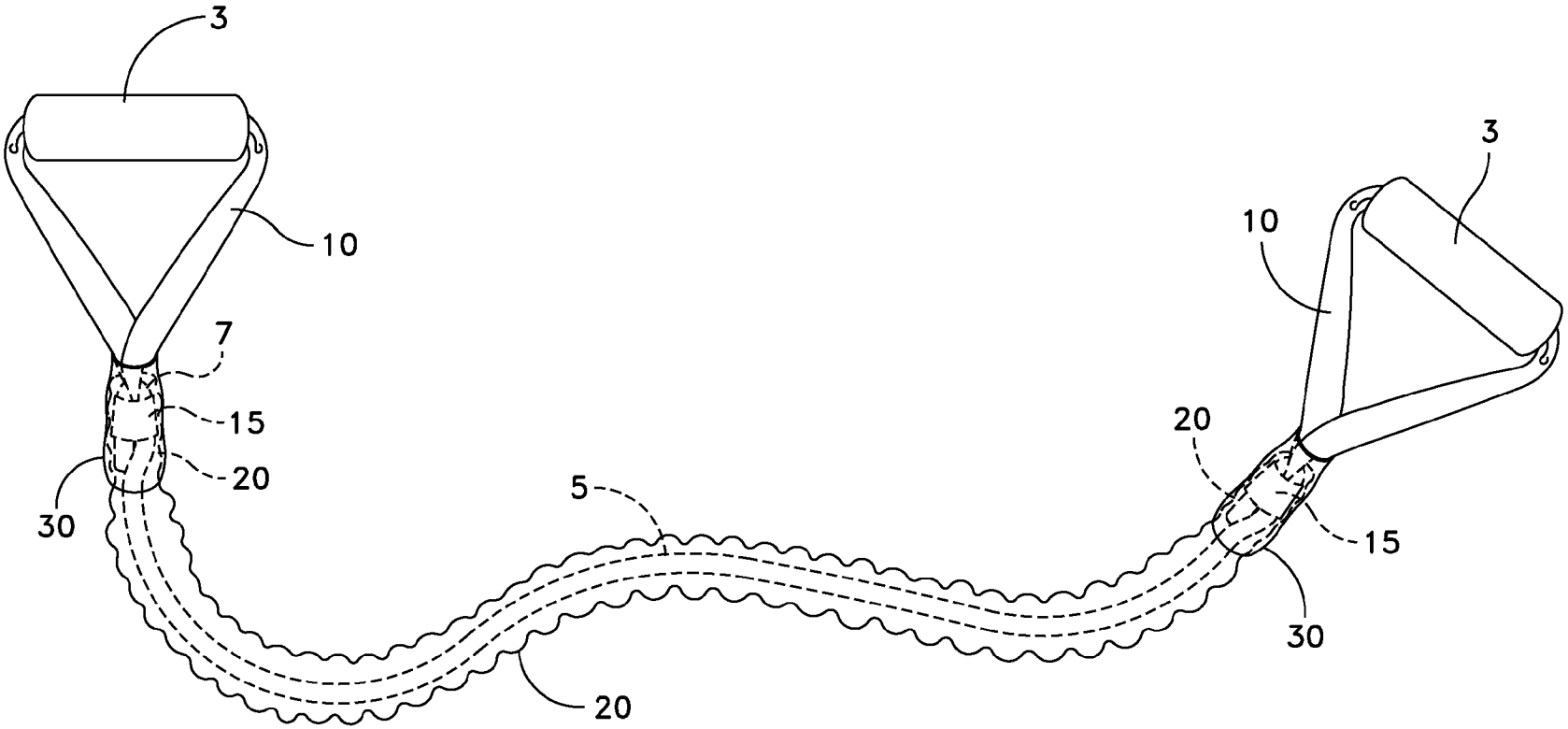
FIG. 4 is a view similar to that shown in FIG. 3 with a different form of end connector.

Reference is first made to FIGS. 1 and 2 for an illustration of the manner in which the end connector is formed with the ends of the elastic device. FIGS. 3 and 4 illustrate the complete elastic device with respectively different end connector arrangements. The basic elastic device is comprised of a flexible and stretchable resistance tube 5 that is initially formed into a loop 7 as illustrated in FIGS. 1 and 2. The flexible and stretchable resistance tube 5 is the inner portion of the elastic device. The outer portion of the elastic device is formed by a flexible and stretchable sleeve 20 that may have an accordion-type outer surface that enables the sleeve to stretch. For further details of the tube 5 and the sleeve 20, reference is made to U.S. Pat. Nos. 5,205,803 and 6,202,263, both of which are hereby incorporated by reference in their entirety.

FIGS. 3 and 4 also illustrate separate embodiments of the elastic device of the present invention. Both of these embodiments employ a strap 10 that may also be formed in a loop and is for supporting at the very end of the connector either a handle 3 as illustrated in FIG. 4 or a clip 4 as illustrated in FIG. 3. The handle 3 is preferably hollow so the strap can pass therethrough. The strap may be a single piece weaved plastic material that is attached at its ends into a loop form. The very ends of the sleeve 20 are preferably stitched to the strap 10. In addition to the handle 3 and the clip 4 that are illustrated herein, numerous other connector arrangements may be used with the elastic device of the present invention.

FIG. 1A illustrates the end of the resistance tube 5 formed into a reversed loop 7. The tube 5 is stretchable along its length. FIG. 1A also illustrates the loop strap 10 and associated handle 3. The strap 10 may be constructed of nylon or polypropylene. FIG. 1B shows the next sequence in which the strap 10, and in particular the handle 3, is about to be passed through the loop 7. This is accomplished by passing the end 3A of the handle through the loop 7 while the strap stays in front of the loop as shown.

FIG. 2A illustrates the handle after having been passed through the loop 7 so that the strap 10 now forms a knot 15 that can be tightly urged against loop 7 to form an attachment between the stretchable resistance tube 5 and the strap 10. FIG. 2A shows the knot is a less tightened position while FIG. 2B shows the knot 15 tightened. One advantage of the connector means of the present invention is that a secure attachment is provided and yet this is accomplished without requiring any holes of passages in the components that are used.

The very ends of the sleeve 20 may be stitched to the strap 10. This may be by a known stitching technique. Alternatively, or in addition, the sleeve 20 may be stitched at the knot 15. It is preferred that the outer sleeve 20 be stitched to the strap such as illustrated at 31 in FIG. 4. FIGS. 3 and 4 also illustrate an additional rubber cover 30 that may be used to improve the aesthetic appearance at the end connectors. The rubber cover 30 is disposed over the ends of the tube 5 and the sleeve 20 and about the knot 15.

The elastic device of the present invention can be used for a number of different applications. For example, it may be used for an exercise device, it may be used in other sports applications and it may be used in nautical applications. As indicated previously, many different types of strap means may be employed other than the illustrated handle and clip. The strap 10 may be a closed loop as illustrated herein or may be an open loop for connection to other types of end connector devices.

Two additional embodiments of the present invention are illustrated in FIGS. 5-9. These two embodiments are similar and both involve the insertion of a ball member within the elastic member and the inclusion of at least one band or strap for securing the connector in place. These added embodiments in FIGS. 5-9 illustrate only the elastic member. However, it is understood that there may also be provided a sleeve member such as the sleeves 20 shown in FIGS. 3 and 4. The sleeve member may be appropriately secured at each end to the respective connectors or if only one connector is used at one end then the sleeve may be secured at that end to either the connector, loop, strap or end of the elastic member itself.

Figure 6:
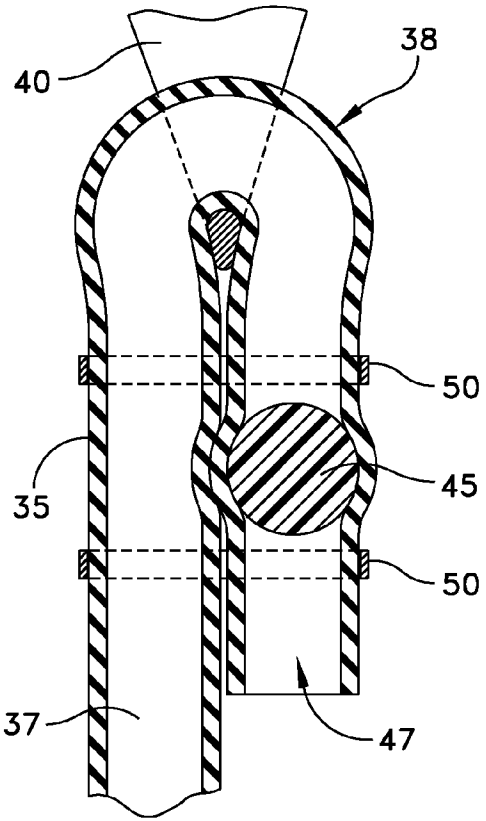
FIG. 6 is a cross-sectional view taken along line 6-6 of FIG. 5.
Figure 5:
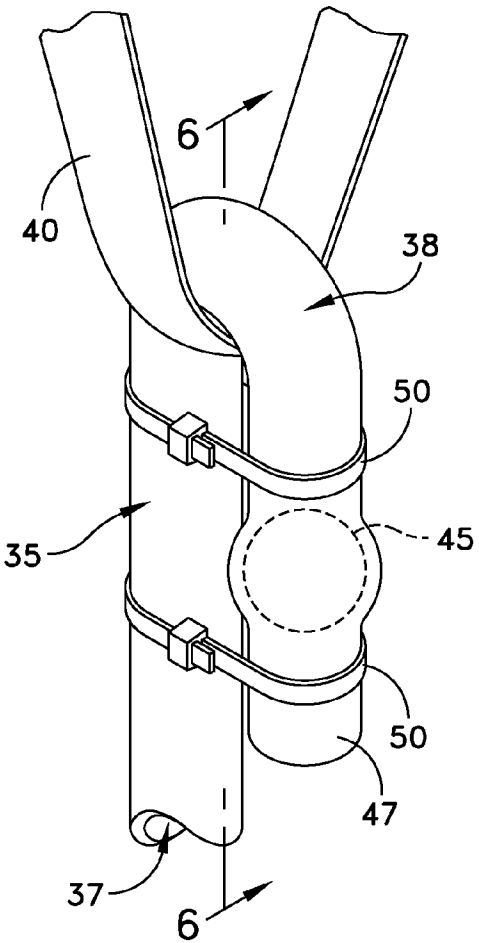
FIG. 5 is a perspective view of a further embodiment of the present invention.

Reference is now made to the embodiment of FIGS. 5 and 6 which illustrate a flexible and stretchable resistance tube or elastic member 35. The tube 35 is preferably hollow as shown at 37. The tube 35 may be hollow along its entire length or just the ends where it is to connect to connector members may it be hollow. As indicated previously the outer portion of the elastic device may be formed as a flexible and stretchable sleeve that may have an accordion-type outer surface such as illustrated previously in FIGS. 3 and 4. In the embodiment of FIGS. 5 and 6 the connector member may be considered, and is simply illustrated, by the strap 40. However, it is understood that there is other types of connector members that may be used with the elastic tube 35.

The elastic member 35 is shown formed in a reverse loop at 38 and extending so as to capture the strap 40. Either before or after forming the loop 38, the rigid ball member 45 is forcibly inserted into the very end 47 of the elastic tube 35. The outer diameter of the ball member 45 is greater than the inner diameter of the elastic tube. However, the elastic tube is elastic in structure and is deflectable so as to receive the ball member 45 therein. The securing with the connector member at strap 40 is furthermore completed by providing at least one band or strap 50. In the embodiment illustrated in FIGS. 5 and 6 two separate straps 50 are used disposed respectively above and below the ball member 45. Each of the straps 50 may be in the form of a known wire tie that can be pulled tightly. In addition, other forms of bands or straps may be used, particularly over the ball member 45 and between the ball member 45 and the strap 40.

Figure 9:
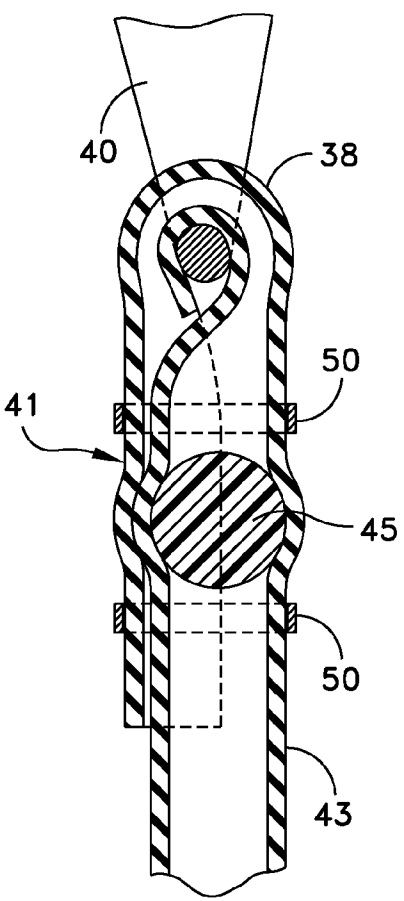
FIG. 9 is a cross-sectional view taken along line 9-9 of FIG. 8.
Figure 8:
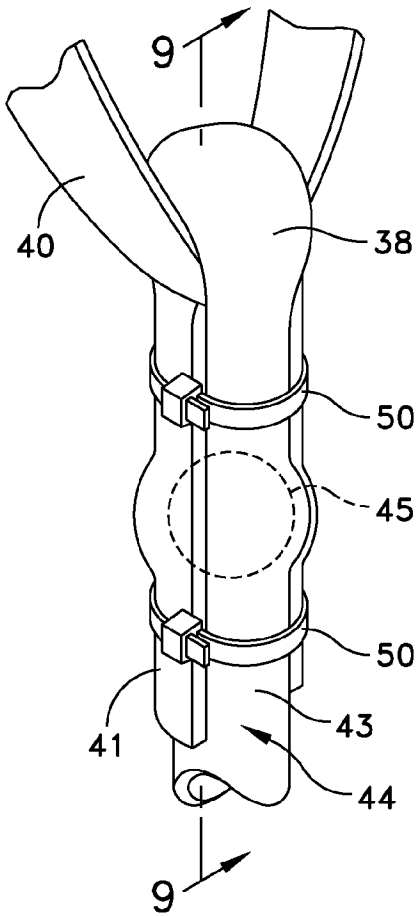
FIG. 8 is a perspective view showing this further embodiment of the present invention.
Figure 7:
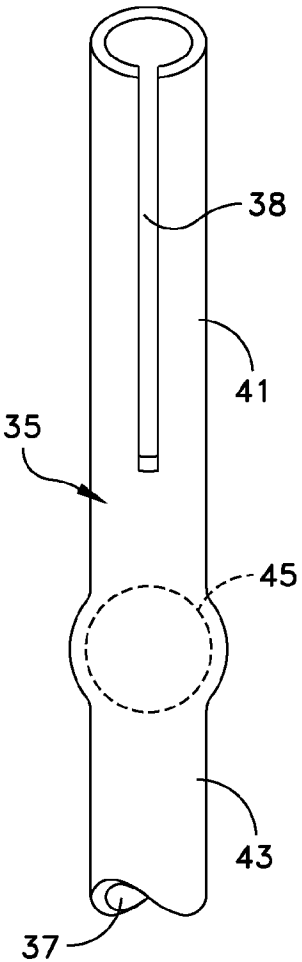
FIG. 7 illustrates a portion of the connector for a further embodiment of the present invention.

Now, reference is made to a further embodiment of the present invention illustrated in FIGS. 7-9. This embodiment is substantially the same as that shown in FIGS. 5 and 6 except for the fact that the tubular member is provided with a slit 38 as illustrated in FIG. 7. In FIGS. 7-9 like reference characters are used to identify like parts as compared to those shown in FIGS. 5 and 6.

As shown in FIG. 7, the rigid ball 45 may be disposed through the slotted end of the flexible member tube 35. The loop 38 is formed for capturing the strap 40 while at the same time the end portion 41 of the flexible member with its longitudinal slot 38 is folded over the base portion 43 of the flexible member or tube 35. When this occurs, the slot 38 is widened as illustrated at 44 in FIG. 8. Thus the end of the flexible member easily fits over the base part of the member forming a neat overlap that captures the strap 40. The additional straps or bands 50 on either side of the rigid ball 45 also assist in forming a firm connection between the elongated flexible member 35 and the connecting member illustrated by a strap portion 40 in FIGS. 8 and 9. Again, with this embodiment, a flexible outer sheath may also be attached over the flexible member 35. This attachment may be either to the loop end of the flexible member, to the straps 50, or in some other way to the strap 40.

In the embodiments illustrated in FIGS. 5-6, two straps 50 are used. However, it is understood that even a single strap may be used tightened adjacent to the area where the ball member 45 is disposed. The ball member 45 itself is sized so as to have a force fit within the elongated and flexible member 35. The ball member 45 is thus not easily disengaged from the elongated member 35. The combination of the ball member with at least one strap 50 provides a very secure arrangement for connecting the end of the flexible member 35 with the connecting member. In the embodiments of FIGS. 5-6 an outer sheath or member may also be provided or optionally not provided.

Having now described a limited number of embodiments of the present invention, numerous other embodiments and modifications thereof are contemplated as falling within the scope of the present invention as defined by the appended claims.

What is claimed is:

1. An elastic exercise device consisting of:

an elongated flexible and stretchable resistance tube having opposed ends that are both formed with a reverse U-shaped open end loop;

each said reverse U-shaped open end loop of the elongated flexible and stretchable resistance tube having a free end with each of the free ends extending in a direction toward the opposite end of the elongated flexible and stretchable resistance tube;

an elongated outer flexible and stretchable sleeve having opposed ends and that is disposed about the elongated flexible and stretchable resistance tube between the opposed ends thereof;

a pair of straps that are each formed as a continuous closed strap loop with each continuous closed strap loop forming a corresponding knot with a respective reverse U-shaped open end loop of the elongated flexible and stretchable resistance tube;

a pair of connector members associated respectively with the pair of continuous closed strap loops;

each said connector member being hollow to define a passage through which the respective continuous closed strap loop extends;

said connector members selected from a hollow handle and clip;

each said knot formed by passing at least a part of the continuous closed strap loop through the reverse U-shaped open end loop of the elongated flexible and stretchable resistance tube so as to form said knot with said reverse U-shaped open end loop; and a cover at each end of the elongated outer flexible and stretchable sleeve, said cover in the form of a tubular cover sleeve that is disposed over and fits along its length with the end of the elongated outer flexible and stretchable sleeve.

2. The elastic exercise device of claim 1 wherein the tubular cover sleeve at the end of the elongated outer flexible and stretchable sleeve extends beyond the end thereof and over a length of the closed loop strap.

3. The elastic exercise device of claim 1 wherein knot is formed by passing an end of the handle through the open end loop from a first side thereof while the strap stays in place about the open end loop at the opposite side thereof.

* * * * *